United States Patent [19]

Alexander, III

[11] 4,223,850

[45] Sep. 23, 1980

[54] SURFACE WIND BATCHER AND METHOD OF COLLECTING MATERIAL IN ROLL FORM

[76] Inventor: William J. Alexander, III, 41 W. Golden Strip Dr., Mauldin, S.C. 29662

[21] Appl. No.: 15,885

[22] Filed: Feb. 28, 1979

[51] Int. Cl.[3] ..... B65H 17/08

[52] U.S. Cl. ..... 242/66

[58] Field of Search ..... 242/66, 65, 67.1 R

[56] References Cited

U.S. PATENT DOCUMENTS

| | | | |
|---|---|---|---|
| 1,455,976 | 5/1923 | Stevens | 242/66 |
| 1,815,218 | 7/1931 | Spear | 242/66 |
| 1,828,888 | 10/1931 | Berry | 242/66 |
| 2,441,439 | 5/1948 | Nelson | 242/66 X |
| 2,461,387 | 2/1949 | Medbery | 242/66 |
| 3,073,539 | 1/1963 | Brown | 242/54 |
| 3,198,449 | 8/1965 | Scher | 242/54 |
| 3,412,950 | 11/1968 | Martin | 242/54 |
| 3,465,979 | 9/1969 | Henry | 242/54 |
| 3,468,529 | 9/1969 | Martin | 270/31 |
| 3,582,010 | 6/1971 | Whiteman | 242/58 |
| 3,695,533 | 10/1972 | Shedyak | 242/55 |
| 3,743,205 | 7/1973 | Misrach | 242/68.7 |
| 4,002,308 | 1/1977 | Feighery | 242/66 |
| 4,084,761 | 4/1978 | Kuckhermann | 242/58.6 |

FOREIGN PATENT DOCUMENTS

| | | | |
|---|---|---|---|
| 675979 | 5/1939 | Fed. Rep. of Germany | 242/66 |

*Primary Examiner*—Edward J. McCarthy
*Attorney, Agent, or Firm*—Luke J. Wilburn, Jr.; Wellington M. Manning, Jr.

[57] ABSTRACT

An improved surface wind batcher and method of collecting material in roll form while maintaining positional stability of the roll during its rotation comprising a pair of rotatably driven parallel side-by-side spaced support rollers which support and peripherally drive a roll of web material fed thereto in continuous length form. The rollers are mounted in movable bearings operated by pneumatic pistons which are automatically actuated during roller and roll rotation to increase the distance between the support rollers and thereby ensure positional stability of the rotating roll on the support rollers. Upon completion of roll formation, the support rollers are actuated to automatically doff the roll of material therefrom and return them to initial closely spaced position for formation of another roll.

14 Claims, 4 Drawing Figures

SURFACE WIND BATCHER AND METHOD OF COLLECTING MATERIAL IN ROLL FORM

This invention relates to improved winding apparatus and method for collecting continuous lengths of web material in roll form, and, more particularly, to an improved web collection device of the type wherein a continuous length of web or sheet material is collected in a roll which is supported and peripherally driven in rotation on a pair of spaced parallel rotatable rollers.

It is known in the prior art to collect a continuous or indefinite length web or sheet material in roll form by supporting the roll on and between a pair of rotatable rollers, with one or more of the rollers being rotatably driven in surface engagement with the roll of material to impart rotation thereto. Such apparatus, commonly referred to in the textile industry as surface wind batchers, may be used in various processing operations, such as roll take-up from a fabric knitting, weaving, tufting or finishing operation, or as a fabric take-up from a cloth inspection apparatus wherein a continuous web of material is fed past an inspection station at relatively high speed and thereafter collected. In such a roll forming apparatus, initial take-up of the web is accomplished by winding a leading end of the web about a suitable support core or cardboard tube located and supported between a pair of spaced parallel rollers. The rollers are rotatably driven and impart rotation to the roll of material through surface contact with the roll.

In web collection operations utilizing apparatus of the type described, difficulties have been encountered in maintaining dimensional stability of the roll of material on the rollers as the roll increases in size, and particularly under high speed take-up operations. It can be appreciated that the support rollers must be closely spaced during initial winding operations in order to properly support and rotate the small diameter of the roll during initial formation, while maintaining the stability of the roll on the spaced support rollers as it increases progressively in size. In an attempt to maintain this stability, it has been a practice in certain prior art devices to provide a central rod extending through the core of the roll of material or resting on the top surface of the roll, which rod rides in a vertical slot of a vertical guide at each end of the collection rollers. However, such systems require time for removal of the central guide rod from the roll before doffing of the roll can be accomplished. It has also been suggested in U.S. Pat. No. 4,084,761 to provide multiple rollers for engaging both upper and lower surfaces of the roll of material during initial web collection, with upper rollers being pivoted by piston means to an inactive position after collection of a few turns of material have started the roll, such a system apparently would not provide for positional stabilization of the roll of material during later winding when the roll diameter increases in size.

It is therefore an object of the present invention to provide an improved high speed surface wind batcher of relatively simplified and economical construction wherein a roll of material can be positionally stabilized throughout the winding operation, and wherein the roll of material may be quickly removed from the winding apparatus during a doffing operation.

It is another object of the present invention to provide a high speed surface wind batcher wherein the distance between a pair of rotatable support rollers for a roll of material may be automatically increased during high speed rotation of the roll to maintain the dimensional stability of the same.

It is a further object of the invention to provide a surface wind batcher wherein a fully wound roll of material may be quickly and easily doffed from the batcher, and the rolls returned to a closely spaced relation to immediately begin formation of another roll of material.

It is yet another object to provide an improved method of high speed web material collection in roll form by means of surface drive rotation of the roll of material while maintaining positional stability of the roll throughout the winding operation.

The above, as well as other objects of the present invention will become more apparent and the invention will be better understood from the following detailed description of a preferred embodiment of the invention, when taken together with the accompanying drawings, in which.

Basically, the present invention comprises a high speed surface wind batcher including a frame having a pair of spaced, side-by-side, parallel, rotatably driven rollers. End shaft portions of each of the rollers are mounted in movable bearings which are operatively connected to fluid-actuated piston means mounted on the frame. The pistons are operated in response to a predetermined signal during web collection to increase the distance between the rollers as the diameter of the roll of the material increases, thereby ensuring positional stability of the rotating roll of material thereon. Upon completion of roll formation, the support rollers are again actuated to doff the roll of material therefrom and return them to initial closely spaced position for formation of another roll.

Figure 1:
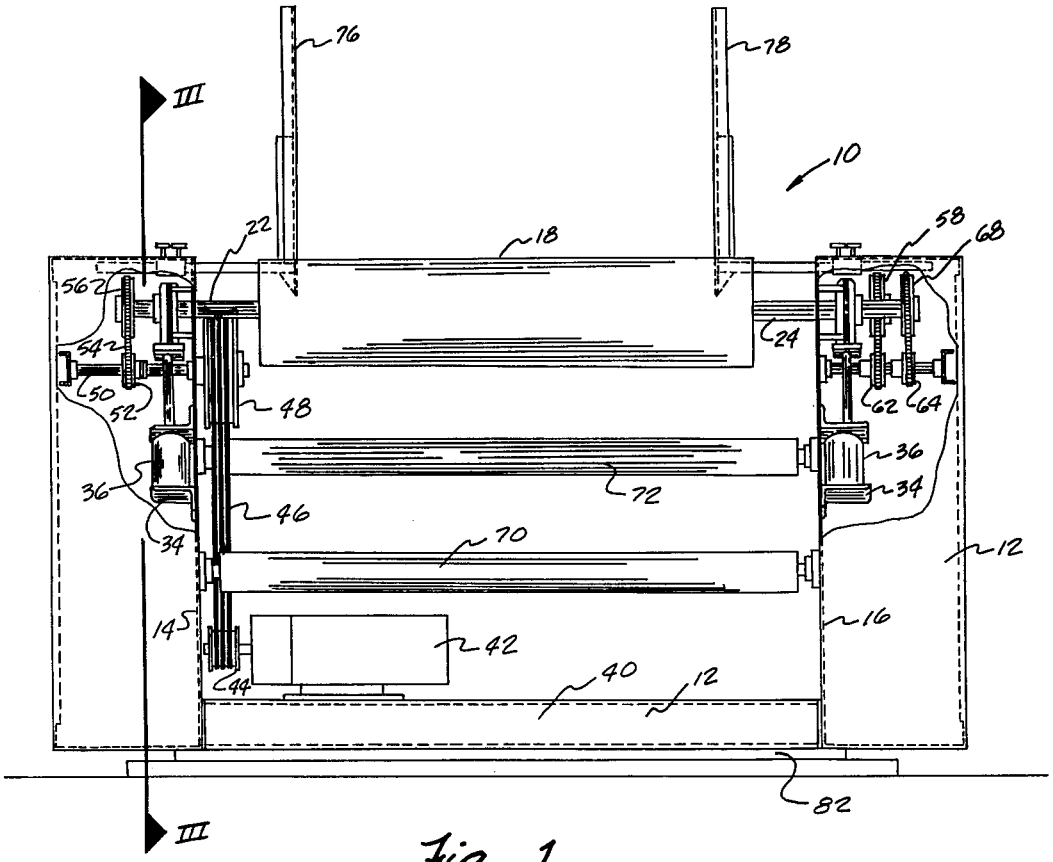
FIG. 1 is a schematic side elevation view of a high speed surface wind batcher of the present invention, with portions of the housing broken away to show the interior thereof.
Figure 2:
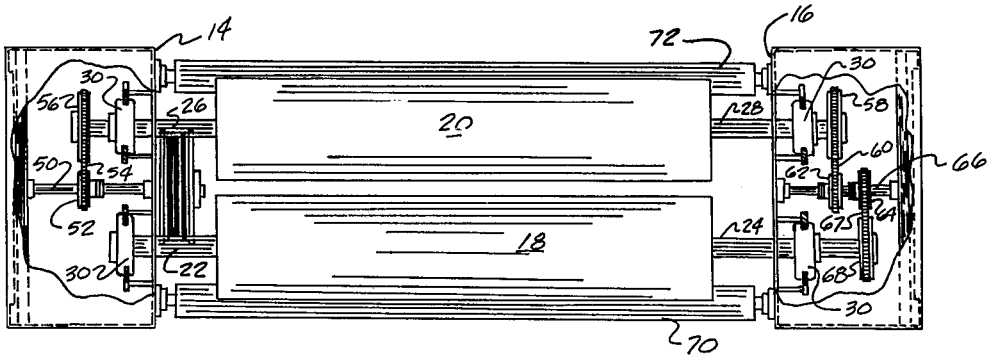
FIG. 2 is a schematic plan view of the batcher of FIG. 1, with portions of the housing broken away.
Figure 3:
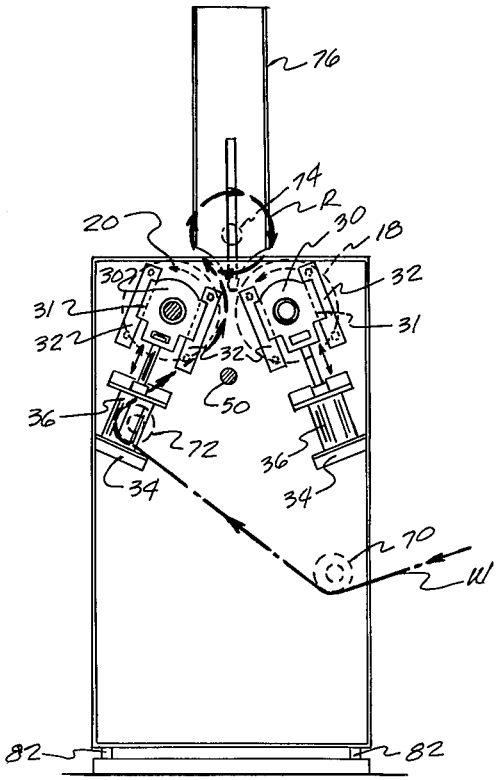
FIG. 3 is a schematic left end sectional elevation view of the batcher taken generally along line III—III of FIG. 1, looking in the direction of the arrows.

Referring more specifically to the drawings, and FIGS. 1–3 therein, the surface wind batcher 10 of the present invention comprises a support frame 12. Mounted for rotation in generally side-by-side, parallel, spaced relation between vertical end walls 14, 16 of end housings or cabinets of the support frame are a pair of support rollers 18, 20, the peripheral surface of each of which may be covered with suitable friction means, such as emery cloth, or the like. Each of the rollers 18, 20 is provided with central, end shaft portions 22, 24, and 26, 28, respectively, which extend through the vertical end walls of the support frame and are rotatably mounted in movable bearings, generally indicated as 30, housed in the end cabinets of the frame.

As best seen in FIG. 3, each of the bearings 30 have side grooves or guideways 31 which slidably engage a pair of spaced guide elements 32 mounted on the end walls of the support frame such that the bearings 30 are free to move in rectilinear directions therealong. Such bearings are generally available in the art and are commonly referred to as take-up bearings, one type of which is sold by Roberts Company.

Mounted by base plates 34 on vertical end walls 14, 16 of support frame 12 below each of the bearings 30 is a fluid-actuated piston 36, the movable piston rod of each of which is attached to the adjacent bearing 30, such that actuation of pistons 36 and movement of their piston rods causes bearings 30 to move upwardly or downwardly on their guide elements 32. As seen in FIG. 3, each bearing and piston which supports an end shaft portion of each roller is mounted for movement at an acute angle of approximately 22.5° to a vertical plane extending between the support rollers, such that pressure actuation of the pistons and corresponding movement of the bearings 30 causes the rollers 18, 20 to move generally angularly upward to decrease the distance between the rollers. Upon release of pressure from pistons 36, the rollers move angularly downward in a rectilinear direction to increase the distance between the rollers. The pistons and bearings supporting one roller move in a plane which defines an angle of approximately 45° with the plane of movement of the pistons and bearings supporting the other roller.

Mounted on a lower horizontal support member 40 of support frame 12 is an electric motor 42, the output shaft of which is drivingly attached by a pulley 44 and endless belts 46 to a larger pulley 48 of a stub shaft 50 which is rotatably mounted in the vertical end walls of frame 12. Mounted on the outer end of stub shaft 50 is a sprocket 52 which is attached by means of an endless chain 54 to a sprocket 56 on the end shaft portion 26 of rotatable roller 220. Mounted on the other end shaft portion 28 of roller 20 is a sprocket 58 which is drivingly attached by means of an endless chain 60 to one of a pair of spaced sprockets 62, 64 fixedly mounted on a second stub shaft 66 which is rotatably supported by bearings in the vertical end walls of the support frame. Sprocket 64 is correspondingly drivingly attached by endless chain 67 to a sprocket 68 mounted on the end shaft portion 24 of roller 18. Thus, operation of motor 42 imparts rotation to roller 20 through first driven means comprising pulleys 44,48 and belts 46, and sprockets 52, 56 and endless chain 54; while second driven means comprising sprockets 58, 62, 64, 68 and endless chains 60, 67 impart similar rotational motion to roller 18. As can be appreciated, the speed of rotation of the rollers as well as the relative speeds of rotation therebetween may be adjusted by changing the size of the pulleys and sprockets drivingly interconnecting the motor to the rollers. For compact build of the roll, it may be desirable to rotate the second roller 18 to engage the web of material at a slightly greater speed that roller 20 which initially engages the incoming web sheet.

In operation, a continuous length of web material, such as a textile fabric W (FIG. 3), is longitudinally directed from a processing machine or apparatus, not shown, by means of a bow roll spreader 70 and guide roller 72 into the area between the two rotatable rollers 18, 20 where the web is engaged by the frictional surface of the roller 20 to be wound about a support tube 74 to form a roll R of the web material. Adjustably positionable between the rollers and extending vertically upward therefrom are a pair of web edge guide plates 76, 78 which engage the edges of the roll of material and facilitate uniform collection of the web on the roll during its rotation by the rollers.

For further guidance of the continuous web onto the roll, the support frame is provided with wheels (not shown) which are mounted on guide tracks 82, and suitable power means, such as a pneumatic motor (not shown), is operatively connected to the wheels to move the entire frame assembly from side to side, as required.

As can be appreciated, at the beginning of the formation of a roll R, the leading end of the web of material may be conveniently wrapped about the small support core or paper tube 74, the diameter of which must be supported between the support rollers for rotation. Thus, the surfaces of the rollers must be close together at the beginning of roll formation, as illustrated in FIGS. 2 and 3. As the diameter of the roll of material increases, it is desirable that the distance between the rollers 18, 20 be increased so that the rollers engage the undersurface of roll R at greater horizontally spaced positions to ensure positional stability of the rotating roll on the rollers, particularly at high speeds.

To accomplish these ends, at the beginning of roll formation, pressurized fluid at a predetermined pressure is supplied to pistons 36 supporting the bearings 30 and support rollers 18, 20 to maintain them in an upper, closely spaced relation. As the roll size increases by a predetermined amount, pressurized fluid is slowly released from the pistons to permit the piston rods and rollers 18, 20 to move slowly downwardly at an angle to a lower position, thus separating the rollers and increasing the distance between the same to accommodate the larger diameter roll. In like manner, when the roll of material reaches a maximum desired diameter, it is desirable to be able to quickly and easily remove the heavy roll of material, often as much as 60 inches in diameter, from the support rollers in a doffing operation.

Figure 4:
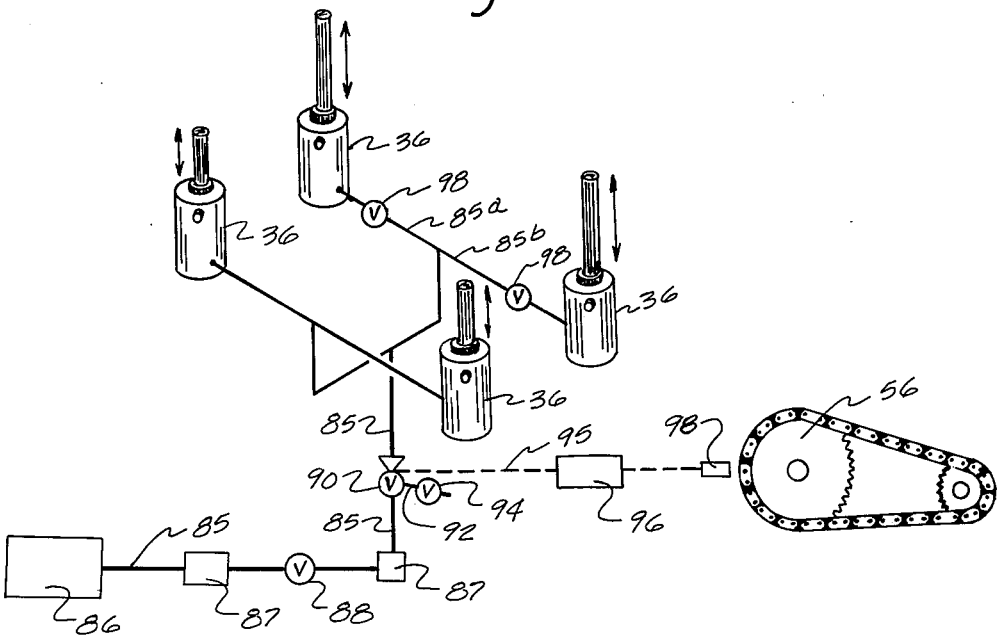
FIG. 4 is a diagrammatic representation of the control means for automatically adjusting the position of the support rollers of the batcher in response to predetermined rotation of the rollers and collection of a roll of material thereon.

Movement of the rollers to perform the above mentioned functions may be best explained by reference to FIG. 4 which is a diagrammatic representation of the pneumatic and electrical control components employed to operate the pistons in the manner desired. Referring to FIG. 4, each of the fluid-actuated pistons 36 is connected by means of suitable supply conduits or tubes 85 to a source of pressurized fluid, such as an air compressor 86. Located in the supply conduit 85 between air compressor 86 and pistons 36 are suitable filters 87, a pressure regulator valve 88, and a three-position solenoid operated valve 90. The solenoid valve 90 is movable, in known manner, between a first position connecting the compressor 86 directly to each of the four pistons, and a second position in which pressurized fluid in the cylinders of the four pistons 36 is permitted to gradually bleed therefrom through exhaust line 92, allowing the piston rods to move downwardly to lower the rollers and thus increse the distance between the surfaces of the rollers 18, 20. The rate at which the pressure is bled from the piston cylinders and thus the rate of separation of rollers 18, 20 may be controlled by means of an adjustable valve 94 in air exhaust line 92. Pressure regulator valve 88 is set to supply sufficient air pressure to the piston cylinders to ensure that the rollers are at all times maintained in uppermost position when pressurized air is supplied to the pistons through valve 90.

During rotation of the roll of material, the positions of the support rollers may be controlled manually or, preferably, as shown in FIG. 4, automatically in response to collection of a given amount of web material on the roll. As seen, solenoid valve 90 is operatively connected by suitable electrical conduit 94 to an adjustable, electrically operated counter 96, such as Model 5-Y-41433 PD-Q predetermined counter manufactured by Durant Digital Instruments. Counter 96 is in turn connected to a conventional proximity switch 98 mounted on the frame of the batcher in immediate proximity to the teeth of one of the drive sprockets, 56, of the rollers. By simple mathematical calculations, it can readily be determined the amount of web material collected on the roll per revolution of the sprocket, and thus the total number of sprocket tooth counts to be set in counter 96 and sensed by proximity switch 98 before solenoid valve 90 is actuated by a signal from counter 96 to bleed air from each of the pistons and allow the rollers to separate to engage the roll R at greater horizontally spaced positions. The control components for the batcher, including proximity switch, electrical counter, valves, and associated pneumatic and electrical conduits and lines are standard components available in the art, and will not be described in detail herein. Such components may be suitably located in the end cabinets of the batcher.

Upon completion of web roll formation, it is desirable to be able to quickly and efficiently remove the roll from the support rollers prior to formation of another roll. To accomplish doffing of the roll, the air conduits 85*a*, 85*b* leading to the pair of support pistons 36 for roller 20 are provided with a restriction therein, which may be achieved by decreasing the diameter of the air conduits or by use of adjustable restricting valves 98 located adjacent the air inlet of the piston cylinders 36. Thus, when the roll of material has reached the desired diameter, as determined visually or automatically by signal from the electrical counter 96, rotation of the rollers is stopped and the three-way solenoid valve 90 is operated to recommunicate pressurized air from compressor 86 directly to the support pistons 36 of the rollers. Because of the restriction in the air conduits 85*a*, 85*b* to the pistons supporting roller 20, pressurized air is supplied to the pistons supporting roller 18 at a faster rate to raise roller 18 upwardly faster than piston roller 20, thus ejecting the roll from the support rollers onto a collection table (not shown).

That which is claimed is:

1. A surface wind batcher for collecting an indefinite length web of material in roll form comprising a support frame, a pair of side by side, spaced, parallel support rollers having support shaft means and being mounted on said frame for engaging spaced undersurface portions of a roll of material across the full width thereof to support the roll therebetween, drive means for rotating each of the support rollers to impart rotation to the roll of material through surface engagement with the roll to build the diameter thereof; and roller adjusting means including fluid actuated piston means mounted on said frame at each end of said rollers, bearing means attached to each of said piston means for movement thereby, each of said bearing means supportably engaging a respective end portion of said shaft means of said roller to permit rotation of said shaft means therein, and to move said rollers in rectilinear directions to increase or decrease the distance between the rollers and maintain positional stability of the roll on the rollers.

2. Apparatus as defined in claim 1 wherein said adjusting means includes means for automatically increasing the distance between the rollers to stabilize the roll of material during rotation in response to the amount of material collected in the roll.

3. Apparatus as defined in claim 1 wherein each of said bearing means includes a bearing member rotatably receiving an end shaft portion of each of said rollers, and means mounting said bearing member on said support frame for sliding movement in a rectilinear direction to raise and lower each of said rollers in respective planes forming an acute angle with a vertical plane extending between said rollers.

4. Apparatus as defined in claim 3 wherein the acute angle of adjustable movement of each of said rollers to the vertical plane is approximately equal.

5. Apparatus as defined in claim 4 wherein the angle between said respective planes is approximately forty-five degrees.

6. Apparatus as defined in claim 3 wherein said adjusting means further includes a source of compressed fluid, conduit means connecting said source of compressed fluid to each of said piston means, pressure regulator valve means in said conduit means for maintaining a predetermined pressure of fluid for supply to said cylinder and piston means, and adjustable valve means in said conduit means between said compressed fluid source and said piston means and operable between a first position for supplying compressed fluid to said piston means at said predetermined pressure to maintain said rollers a predetermined distance apart, and a second position for gradually releasing pressurized fluid from each of said piston means to cause progressive increase in the distance between said rollers over a period of rotation of the roll of material thereon.

7. Apparatus as defined in claim 6 including means in said conduit means for introducing pressurized fluid to the piston means of one of said rollers at a slower rate than the pressurized fluid is introduced to the piston means of the other of said rollers whereby said one of said rollers rises at a faster rate to displace a roll of material from said rotatable rollers for doffing the roll.

8. Apparatus as defined in claim 1 wherein said drive means comprises motor means operatively associated with said frame, first driven means supported on said frame and operatively connecting said motor means to one end portion of one of said roller shaft means for rotatably driving the roller, and second driven means operatively connecting an end portion of said one roller shaft means to the adjacent end portion of the shaft means of the other roller to impart rotary motion to said other roller.

9. Apparatus as defined in claim 8 wherein said first and second driven means includes endless flexible elements operatively connecting said motor means to said one end portion of one of said roller shaft means, and endless flexible elements connecting the other end portion of said one roller shaft means to the adjacent end portion of the shaft means of the other roller, said endless flexible elements being positioned with respect to said movable means to impart rotation to said rollers during their movement in said rectilinear directions to increase or decrease the distance therebetween.

10. Apparatus as defined in claim 1 wherein said drive means includes means for rotating one of said rollers at a different rate of speed than the other of said rollers.

11. A surface wind batcher for collecting a web of material in roll form comprising a support frame, a pair of support rollers, bearing means mounting said rollers on said support frame for rotation about their central axes and in side-by-side, spaced, parallel relation to engagably support a roll of material along its width therebetween; drive means for rotating said rollers to impart rotation to a roll of material therebetween, said drive means including motor means, first driven means interconnecting said motor means to one of said rollers to impart rotation thereto, and second driven means interconnecting said one of said rollers to the other of said rollers to impart rotation thereto; fluid-actuated means mounted on said frame and attached to said bearing means for moving said bearing means and rollers during their rotation to increase or decrease the distance between the rollers; and means for automatically sensing the amount of revolution of said rollers and for varying fluid pressure supplied to said fluid actuated means to move said rollers to vary the distance therebetween in response to a predetermined amount of rotation thereof.

12. Apparatus as defined in claim 11 wherein said automatic sensing and fluid pressure varying means comprises electrically operated detector means positioned adjacent said first or second driven means for detecting incremental amounts of movement thereof, counter means operatively connected to said detector means for recording the number of said incremental amounts of movement of said driven means and for initiating an electrical signal in response to a preselected number of such incremental movements to vary fluid pressure supplied to said fluid-actuated means to increase the distance between said rollers and maintain positional stability of a roll of material being collected thereon.

13. Apparatus as defined in claim 12 wherein said first driven means includes sprocket means operatively attached to one of said rollers for rotation therewith, and chain means drivingly engaging said sprocket means to impart rotation to said roller; and wherein said detector means includes proximity switch means positioned adjacent said sprocket means for detecting the number of teeth of the sprocket means passing said proximity switch during rotation of said roller, said proximity switch means being electrically connected to said counter means to record the number of sprocket teeth so detected.

14. A method for collecting an indefinite length web of material in roll form on a pair of spaced rotatably driven support rollers while maintaining positional stability of the rotating roll comprising the steps of:

(a) continuously directing an indefinite length of web material into engagement with the peripheral surfaces of said rotatably driven rollers while forming a rotating roll of material supported therebetween;

(b) automatically moving said rollers during their rotation to increase the distance between the rollers as the roll of material being rotatably supported thereon increases in diameter, whereby positional stability of the rotating roll of material on the rollers is maintained; and (c) rectilinearly moving one of said rollers in an upward direction and at a greater speed of movement than the other of said rollers to displace the roll of material from the rollers when a desired amount of web material has been collected thereon.

* * * * *

UNITED STATES PATENT AND TRADEMARK OFFICE

CERTIFICATE OF CORRECTION

PATENT NO. : 4,223,850

DATED : September 23, 1980

INVENTOR(S) : William J. Alexander, III

It is certified that error appears in the above-identified patent and that said Letters Patent are hereby corrected as shown below:

Column 3, line 33, "220" should read--20--.

Column 3, line 53, "that" should read--than--.

Column 4, line 54, "increse" should read--increase--.

Column 5, line 59, claim 1, "said", second occurrence, should read--each--.

Signed and Sealed this

*Third* Day of *February 1981*

[SEAL]

*Attest:*

RENE D. TEGTMEYER

*Attesting Officer*

*Acting Commissioner of Patents and Trademarks*